US011753780B2

(12) United States Patent
Zhan et al.

(10) Patent No.: US 11,753,780 B2
(45) Date of Patent: Sep. 12, 2023

(54) MID-SPAN AXIAL FORCE-FREE CONNECTING DEVICE FOR EARTH-ANCHORED CABLE-STAYED BRIDGE AND METHOD FOR MOUNTING SAME

(71) Applicants: Hubei Communications Planning and Design Institute Co., Ltd., Wuhan (CN); Hubei Jiaotou Shixi Expressway Co., Ltd., Wuhan (CN)

(72) Inventors: Jianhui Zhan, Wuhan (CN); Yuan Liao, Wuhan (CN); Wangxing Ding, Wuhan (CN); Yan Yang, Hanyang District (CN); Yuqing Liu, Wuhan (CN); Feng Shen, Wuhan (CN); Zhaohui Liu, Wuhan (CN); Shoufeng Tang, Wuhan (CN); Ming Zhang, Wuhan (CN); Jinxia Zhao, Wuhan (CN); Yajun Zhang, Wuhan (CN); Bo Yao, Wuhan (CN); Shan Pei, Wuhan (CN); Qifen Wei, Wuhan (CN); Zuowei Qin, Wuhan (CN); Xiaoqing Liu, Wuhan (CN); Wuzhou Hu, Wuhan (CN); Jing Liu, Wuhan (CN); Xingzhi Chen, Wuhan (CN); Hua Chen, Wuhan (CN); Wei Jiang, Wuhan (CN)

(73) Assignees: HUBEI COMMUNICATIONS PLANNING AND DESIGN INSTITUTE CO., LTD., Wuhan (CN); HUBEI JIAOTOU SHIXI EXPRESSWAY CO., LTD., Wuhan (CN)

( * ) Notice: Subject to any disclaimer, the term of this patent is extended or adjusted under 35 U.S.C. 154(b) by 0 days.

(21) Appl. No.: 18/094,454

(22) Filed: Jan. 9, 2023

(65) Prior Publication Data

US 2023/0228045 A1 Jul. 20, 2023

(30) Foreign Application Priority Data

Jan. 14, 2022 (CN) ..... 202210042357.0

(51) Int. Cl.
*E01D 11/04* (2006.01)
*E01D 21/00* (2006.01)

(52) U.S. Cl.
CPC ..... *E01D 21/00* (2013.01); *E01D 11/04* (2013.01)

(58) Field of Classification Search
CPC ..... E01D 11/04; E01D 21/00
(Continued)

(56) References Cited

U.S. PATENT DOCUMENTS 595,629 A * 12/1897 Horton ..... E04C 3/42 14/73.5
2,909,253 A * 10/1959 Hinze ..... E04G 11/56 403/106

(Continued)

FOREIGN PATENT DOCUMENTS

CN 107326800 A 11/2017
GB 899626 A * 6/1962 ..... E01B 25/12

*Primary Examiner* — Raymond W Addie
(74) *Attorney, Agent, or Firm* — MaxGoLaw PLLC

(57) ABSTRACT

The present disclosure discloses a mid-span axial force-free connecting device for an earth-anchored cable-stayed bridge and a method for mounting same. The mid-span axial force-free connecting device for an earth-anchored cable-stayed bridge includes an externally sleeved large steel box girder and an internally embedded small steel box girder. A plurality of bearing beams are arranged on the inner periphery of the externally sleeved large steel box girder. Transverse spherical bearings or vertical spherical bearings are arranged on the bearing beams. The internally embedded small steel box girder is fixedly supported in the externally sleeved large steel box girder through a plurality of trans- (Continued)

verse spherical bearings and vertical spherical bearings. In the same section, the transverse spherical bearings are symmetrically arranged, and the vertical spherical bearings are also symmetrically arranged.

10 Claims, 2 Drawing Sheets

(58) Field of Classification Search
USPC ..... 14/18–24, 73.1–78
See application file for complete search history.

(56) References Cited

U.S. PATENT DOCUMENTS

| | | | | |
|---|---|---|---|---|
| 2,974,762 | A * | 3/1961 | Hunnebeck | E04G 11/56 52/645 |
| 3,180,463 | A * | 4/1965 | Romek | E04G 11/56 52/632 |
| 3,245,328 | A * | 4/1966 | Fassbinder | E01D 19/062 404/47 |
| 10,280,618 | B2 * | 5/2019 | Kelly | E04C 3/07 |

* cited by examiner

MID-SPAN AXIAL FORCE-FREE CONNECTING DEVICE FOR EARTH-ANCHORED CABLE-STAYED BRIDGE AND METHOD FOR MOUNTING SAME

CROSS-REFERENCE TO RELATED APPLICATION

This patent application claims the benefit and priority of Chinese Patent Application No. 202210042357.0, filed with the China National Intellectual Property Administration on Jan. 14, 2022, the disclosure of which is incorporated by reference herein in its entirety as part of the present application.

TECHNICAL FIELD

The present disclosure relates to the technical field of bridge engineering, and in particular, to a mid-span axial force-free connecting device for an earth-anchored cable-stayed bridge and a mounting method thereof.

BACKGROUND

A cable-stayed bridge is a high-order statically indeterminate composite flexible structural system with a superstructure composed of three basic components of a pressure bearing tower, a tension bearing cable, and a bending bearing beam, which has been developed rapidly at home and abroad in recent years due to its high spanning capacity, good stress performance, and attractive appearance. In an earth-anchored cable-stayed bridge, part stay cables with a great horizontal component of a side span cable force are anchored to anchorages. On one hand, the stiffness and the static stability of an earth anchor cable and a cable tower can be increased, and an excessive axial pressure inside a main beam close to a tower area and an axial tension force of a mid-span beam segment of a main span in a self-anchored cable-stayed bridge can be reduced; and on the other hand, the ratio of side span to mid span of the earth-anchored cable-stayed bridge is small, the total length of the main beam is short, and the using amount of the materials of main beams and stay cables are reduced, the total cantilever length of the main beam in a construction stage is greatly reduced, the construction difficulty is reduced, and the safety of the construction stage is improved.

Chinese invention patent (Publication No. CN107326800A) discloses a double-layer steel box type axial force-free hinge device in 2017, which includes a steel box and a supporting beam arranged on the main beam. The steel box is fixed to the supporting beam through sliding plate bearings. Concrete is cast in situ in a main beam span and an expansion joint is mounted. The steel box includes an upper steel box and a lower steel box. A sliding layer is arranged between the upper steel box and the lower steel box. The upper steel box and the lower steel box are respectively fixed to the supporting beam through the sliding plate bearings. Although the device facilitates later sliding adjustment to a certain extent, the concrete needs to be cast in situ in a mounting construction process. The construction progress is slow, and the stress performance between the upper steel box and the lower steel box is not very good.

Under the action of a long-term temperature difference effect, the longitudinal free expansion of the main beam of the cable-stayed bridge is constrained by a tower column, so huge bending moment will be generated in the tower column, and simultaneously, an additional tension or pressure will be generated in the main beam. This problem has not been effectively solved.

At present, several structural forms similar to a mid-span axial force-free connecting device are proposed to effectively solve longitudinal large displacement and additional stress caused by the actions of temperature difference change, concrete shrinkage and creep, earthquakes, etc. of a large-span bridge. However, the existing structural form has the following problems: on one hand, these structural forms are not completely applicable to an earth-anchored cable-stayed bridge; and on the other hand, there is still a large improvement space in the aspects of force transfer performance of a system, convenience of construction, feasibility, and convenience of maintenance and replacement during operation, etc.

SUMMARY

An objective of the present disclosure is to provide a mid-span axial force-free connecting device for an earth-anchored cable-stayed bridge and a method for mounting same for the problems in the prior art.

In order to achieve the abovementioned objective, the technical solution adopted by the present disclosure is that:

A mid-span axial force-free connecting device for an earth-anchored cable-stayed bridge includes an externally sleeved large steel box girder and an internally embedded small steel box girder arranged inside the externally sleeved large steel box girder. A plurality of bearing beams are arranged on the inner periphery of the externally sleeved large steel box girder. Transverse spherical bearings or vertical spherical bearings are arranged on the bearing beams. The internally embedded small steel box girder is fixedly supported in the externally sleeved large steel box girder through a plurality of transverse spherical bearings and vertical spherical bearings. In the same section, the transverse spherical bearings are symmetrically arranged, and the vertical spherical bearings are also symmetrically arranged.

According to the axial force-free connecting device, due to the arrangement of the abovementioned structure, longitudinal large displacement and additional stress caused by the actions of temperature difference change, concrete shrinkage and creep, earthquakes, etc. of a large-span bridge can be effectively solved, the stress performance of the large-span bridge can be effectively improved, and higher crossing and passing capacity of a modern bridge can be realized. In addition, the overall structural system is smooth in force transfer, convenient to construct, and convenient to operate, maintain and replace.

In order to ensure that the load born by the externally sleeved large steel box girder can be effectively transferred through the internally embedded small steel box girder, the externally sleeved large steel box girders on both sides are respectively provided with two of the bearing beams. Each of the bearing beams is provided with one vertical spherical bearing on an upper side and a lower side and two transverse spherical bearings on a left side and a right side. The internally embedded small steel box girder can be arranged inside the externally sleeved large steel box girder through the vertical and transverse spherical bearings. A pre-tightening force is applied to each vertical and transverse spherical bearing, so that the internally embedded small steel box girder and the externally sleeved large steel box girders on both sides form a whole body. On one hand, the vertical and transverse spherical bearings transfer the load and the deformation of the externally sleeved large steel box girder to the internally embedded small steel box girder through the counterforce and the rotation of the bearings. On the other hand, the relative longitudinal displacement and axial force between the externally sleeved large steel box girders can be released through the friction between the bearing and the internally embedded small steel box girder. The stress is improved obviously, and the safety is higher.

All of the fabrication of the externally sleeved large steel box girder, the fabrication and splicing of the internally embedded small steel box girder, and the fabrication and mounting of the vertical spherical bearings and the transverse spherical bearings can be completed in a factory. Only the overall hoisting and mounting are performed on a construction site, which accelerates the construction progress.

When the load of the externally sleeved large steel box girder is transferred to the internally embedded small steel box girder through the vertical spherical bearings and the transverse spherical bearings, certain deformation of the internally embedded small steel box girder is allowed, which effectively improves the force transfer performance. Due to symmetrical arrangement, the overall system can be stressed uniformly, and force can be transferred more directionally.

Further, there are 16 transverse spherical bearings and 8 vertical spherical bearings. The vertical spherical bearings are arranged on the upper side and the lower side; and the transverse spherical bearings are arranged on the left side and the right side.

The height dimension of the internally embedded small steel box girder is greater than the width dimension of an upper end face and a lower end face, so that four transverse spherical bearings are symmetrically arranged on both sides of a height direction of the internally embedded small steel box girder, and two vertical spherical bearings are symmetrically arranged on the upper side and the lower side. Thus, the left side and the right side can be well supported and stressed, and the stress cannot be concentrated at one position.

Further, a plurality of bearing beams are circumferentially arranged on the inner periphery of the externally sleeved large steel box girder at intervals. One vertical spherical bearing is arranged on each of the upper side and the lower side of the bearing beam; and two transverse spherical bearings are arranged on each of the left side and the right side of the bearing beam. That is, in the length direction, four bearing beams are arranged at intervals. The bearing beams are circumferentially arranged on the inner periphery. Thus, the whole circumferential force can be born and dispersed and transferred all around. The numbers and the positions of the transverse spherical bearings and the vertical spherical bearings arranged on each bearing beam are the same.

Further, the transverse spherical bearings and the vertical spherical bearings are two-way bearings respectively, so that both ends of each of the transverse spherical bearings and the vertical spherical bearings can be connected and mounted. Moreover, the structure is symmetrical, which not only has good stress performance, but also facilitates mounting and using. Spherical two-way special bearings are used, which allows longitudinal and transverse rotation, and facilitates the adjustment of stress.

Further, leveling pads are respectively arranged at the two ends of each of the transverse spherical bearings and the vertical spherical bearings. The leveling pads can adjust the positions of the vertical spherical bearings and the transverse spherical bearings and apply a pre-tightening force to these bearings, which can ensure that the mounted internally embedded small steel box girder is placed horizontally absolutely, reduce the risk that the internally embedded small steel box girder is disengaged from the vertical spherical bearings and the transverse spherical bearings, and improve the safety performance.

Further, the bearing beam is formed by welding a plurality of partition plates, which is simple and effective in structure, and easy to fabricate.

Further, a plurality of small beams are also circumferentially arranged on the inner periphery of the externally sleeved large steel box girder; and a plurality of longitudinal beams are arranged between each small beam and the corresponding bearing beam.

The strength and the stability of the externally sleeved large steel box girder can be enhanced by the arrangement of the small beams and the longitudinal beams. Moreover, the longitudinal beams can be connected to a grid-shaped spatial structure of the inner periphery formed by the bearing beams and the small beams, which improves the stress performance while providing effective support. The structural strength and the stability of the longitudinal beams are also improved.

Further, the externally sleeved large steel box girder is a discontinuous large steel box girder; and a sealing device is mounted at a discontinuous position of the externally sleeved large steel box girder. The large steel box girder arranged in this way facilitates the mounting of the internally embedded steel box girder, and reduces the construction difficulty.

Further, the internally embedded small steel box girder is a segmental symmetric prefabricated structure; and all sections of structures are spliced by high-strength bolts or welding. Prefabrication in a factory is facilitated, and the assembling on site is facilitated.

A method for mounting the mid-span axial force-free connecting device for an earth-anchored cable-stayed bridge includes the following steps:

(1) prefabricating and producing the externally sleeved large steel box girder and the internally embedded small steel box girder in a factory, and transporting to a construction site for later use;

(2) respectively mounting a plurality of leveling pads on each bearing beam in the externally sleeved large steel box girder according to an upper-lower and left-right symmetrical relationship, and then respectively mounting the transverse spherical bearings and the vertical spherical bearings on the bearing leveling pads according to a transverse-vertical relationship;

(3) after the externally sleeved large steel box girder is subjected to centering and spacing adjustment, adjusting the vertical spherical bearings and the transverse spherical bearings to preset positions;

(4) hoisting and feeding the internally embedded small steel box girder into the externally sleeved large steel box girder, adjusting the leveling pads to ensure that the internally embedded small steel box girder closely fits the vertical spherical bearings and the transverse spherical bearings, and horizontally placing the mounted internally embedded small steel box girder; respectively applying a pre-tightening force to the transverse spherical bearings and the vertical spherical bearings in a mounting process of the internally embedded small steel box girder;

(5) after the internally embedded small steel box girder is mounted, a longitudinal limiting stop block is arranged at each of the two ends of the internally embedded small steel box girder; and finally, mounting a sealing device at a discontinuous position of the externally sleeved large steel box girder.

The mounting method is simple, and effectively improves the construction progress of a steel box girder. The mounted internally embedded small steel box girder has good levelness, and both the stability and stress characteristics are superior to those of an ordinary steel box girder. The thickness dimension of the leveling pad is adjusted correspondingly in combination with a final bridge line and on-site monitoring data in an actual machining process. The applied pre-tightening force value is adjusted correspondingly according to an actual engineering stress condition and the allowable longitudinal displacement, and the longitudinal limit value allows the longitudinal displacement to be adjusted correspondingly in actual engineering.

Compared with the prior art, the present disclosure has the beneficial effects that: 1, according to the axial force-free connecting device, due to the arrangement of the abovementioned structure, longitudinal large displacement and additional stress caused by the actions of temperature difference change, concrete shrinkage and creep, earthquakes, etc. of a large-span bridge can be effectively solved, the stress performance of the large-span bridge can be effectively improved, and higher crossing and passing capacity of a modern bridge can be realized; in addition, the overall structural system is smooth in force transfer, convenient to construct, and convenient to operate, maintain and replace; 2, on one hand, the vertical and transverse spherical bearings transfer the load and the deformation of the externally sleeved large steel box girder to the internally embedded small steel box girder through the counterforce and the rotation of the bearings; on the other hand, the relative longitudinal displacement and axial force between the externally sleeved large steel box girders can be released through the friction between the bearing and the internally embedded small steel box girder; the stress is improved obviously, and the safety is higher; 3, the fabrication of the externally sleeved large steel box girder, the fabrication and splicing of the internally embedded small steel box girder, and the fabrication and mounting of the vertical spherical bearings and the transverse spherical bearings can be completed in a factory; only the overall hoisting and mounting are performed on a construction site, which accelerates the construction progress; and 4, when the load of the externally sleeved large steel box girder is transferred to the internally embedded small steel box girder through the vertical spherical bearings and the transverse spherical bearings, certain deformation of the internally embedded small steel box girder is allowed, which effectively improves the force transfer performance.

DETAILED DESCRIPTION OF THE EMBODIMENTS

Technical solutions in the present disclosure will be clearly and completely described below with reference to the drawings in the present disclosure. Apparently, the described embodiments are merely part rather than all of the embodiments of the present disclosure. All other embodiments obtained by those of ordinary skill in the art based on the embodiments of the present disclosure without creative efforts shall fall within the scope of protection of the present disclosure.

In the descriptions of the present disclosure, it is to be noted that orientations or positional relationships indicated by the terms "middle", "upper", "lower", "left", "right", "inner", and "outer" are orientations or positional relationships shown based on the drawings, and are merely for the convenience of describing the present disclosure and simplifying the description, rather than indicating or implying that the devices or elements must have a particular orientation, and constructed and operated in the particular orientation. Thus, it cannot be construed as a limitation to the present disclosure. In addition, terms "first", "second", etc. are merely used for description, and cannot be understood as indicating or implying relative importance.

Embodiment 1

Figure 1:
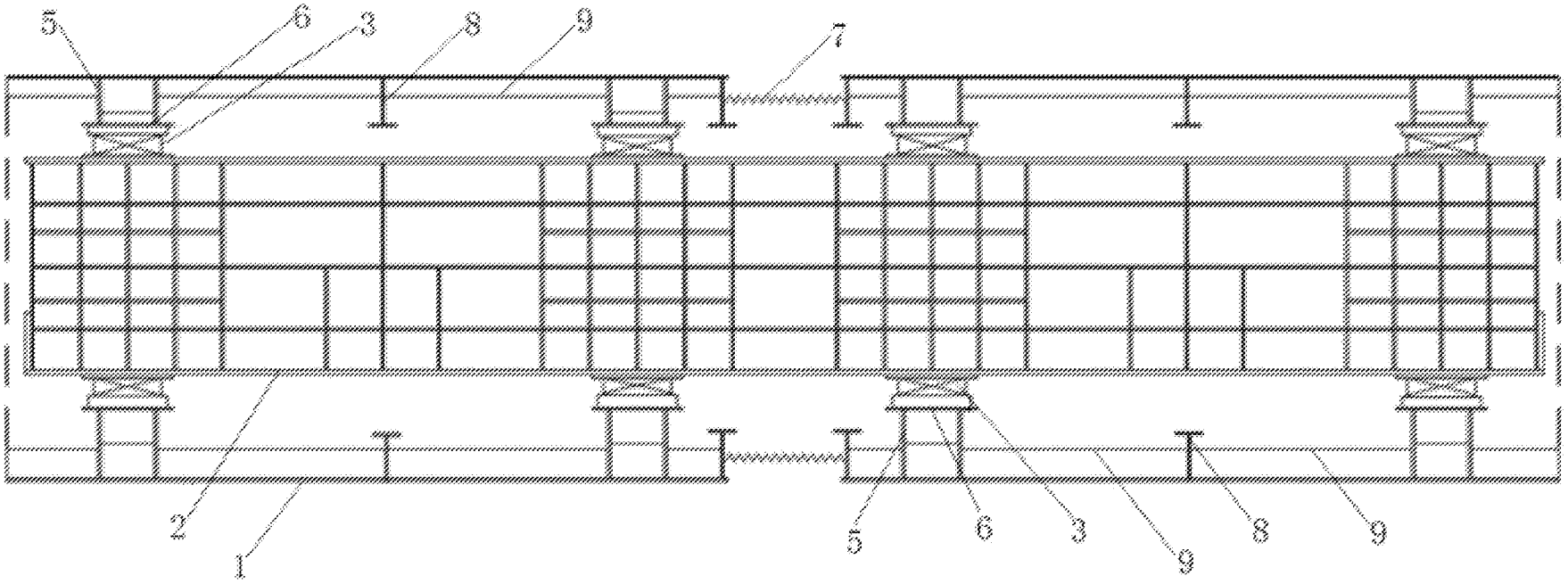
FIG. 1 is a schematic structural diagram of a facade of a mid-span axial force-free connecting device for an earth-anchored cable-stayed bridge of the present disclosure.
Figure 2:
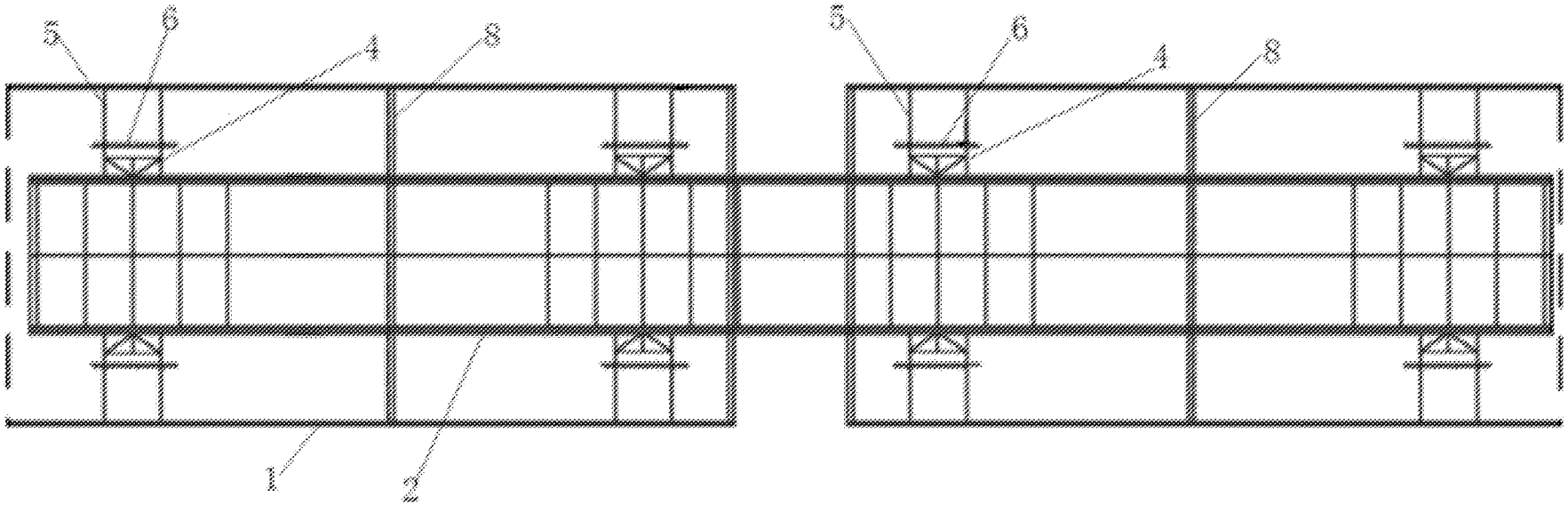
FIG. 2 is a schematic structural diagram of a plane of the mid-span axial force-free connecting device for an earth-anchored cable-stayed bridge of the present disclosure; and reference signs in the drawings: 1—externally sleeved large steel box girder; 2—internally embedded small steel box girder; 3—vertical spherical bearing; 4—transverse spherical bearing; 5—bearing beam; 6—leveling pad; 7—sealing device; 8—small beam; and 9—longitudinal beam.

As shown in FIG. 1 and FIG. 2, a mid-span axial force-free connecting device for an earth-anchored cable-stayed bridge includes an externally sleeved large steel box girder 1 and an internally embedded small steel box girder 2 arranged inside the externally sleeved large steel box girder 1. A plurality of bearing beams 5 are arranged on the inner periphery of the externally sleeved large steel box girder 1. Transverse spherical bearings 4 or vertical spherical bearings 3 are arranged on the bearing beams 5. The internally embedded small steel box girder 2 is fixedly supported in the externally sleeved large steel box girder 1 through a plurality of transverse spherical bearings 4 and vertical spherical bearings 3. In the same section, the transverse spherical bearings 4 are symmetrically arranged, and the vertical spherical bearings 3 are also symmetrically arranged.

According to the axial force-free connecting device, due to the arrangement of the abovementioned structure, longitudinal large displacement and additional stress caused by the actions of temperature difference change, concrete shrinkage and creep, earthquakes, etc. of a large-span bridge can be effectively solved, the stress performance of the large-span bridge can be effectively improved, and higher crossing and passing capacity of a modern bridge can be realized. In addition, the overall structural system is smooth in force transfer, convenient to construct, and convenient to operate, maintain and replace.

In order to ensure that the load born by the externally sleeved large steel box girder 1 can be effectively transferred through the internally embedded small steel box girder 2, the externally sleeved large steel box girders 1 on both sides are respectively provided with two bearing beams 5. Each of the bearing beams 5 is provided with one vertical spherical bearing 3 on an upper side and a lower side and two transverse spherical bearings 4 on a left side and a right side. The internally embedded small steel box girder 2 can be arranged inside the externally sleeved large steel box girder 1 through the vertical and transverse spherical bearings. A pre-tightening force is applied to each vertical and transverse spherical bearing, so that the internally embedded small steel box girder 2 and the externally sleeved large steel box girders 1 on both sides form a whole body. On one hand, the vertical and transverse spherical bearings transfer the load and the deformation of the externally sleeved large steel box girder 1 to the internally embedded small steel box girder 2 through the counterforce and the rotation of the bearings. On the other hand, the relative longitudinal displacement and axial force between the externally sleeved large steel box girders 1 can be released through the friction between the bearing and the internally embedded small steel box girder 2. The stress is improved obviously, and the safety is higher.

The fabrication of the externally sleeved large steel box girder 1, the fabrication and splicing of the internally embedded small steel box girder 2, and the fabrication and mounting of the vertical spherical bearings 3 and the transverse spherical bearings 4 can be completed in a factory. Only the overall hoisting and mounting are performed on a construction site, which accelerates the construction progress.

When the load of the externally sleeved large steel box girder 1 is transferred to the internally embedded small steel box girder 2 through the vertical spherical bearings 3 and the transverse spherical bearings 4, certain deformation of the internally embedded small steel box girder 2 is allowed, which effectively improves the force transfer performance. Due to symmetrical arrangement, the overall system can be stressed uniformly, and force can be transferred more directionally.

Further, there are 16 transverse spherical bearings 4 and 8 vertical spherical bearings 3. The vertical spherical bearings 3 are arranged on the upper side and the lower side; and the transverse spherical bearings 4 are arranged on the left side and the right side.

The height dimension of the internally embedded small steel box girder 2 is greater than the width dimension of an upper end face and a lower end face, so that four transverse spherical bearings 4 are symmetrically arranged on the both sides the same section in a height direction of the internally embedded small steel box girder 2, and two vertical spherical bearings 3 are symmetrically arranged on the upper side and the lower side. Thus, the left side and the right side can be well supported and stressed, and the stress cannot be concentrated at one position.

Further, a plurality of bearing beams 5 are circumferentially arranged on the inner periphery of the externally sleeved large steel box girder 1 at intervals. One vertical spherical bearing 3 is arranged on each of the upper side and the lower side of the bearing beam 5; and two transverse spherical bearings 4 are arranged on each of the left side and the right side of the bearing beam. That is, in the length direction, four bearing beams 5 are arranged at intervals. The bearing beams 5 are circumferentially arranged on the inner periphery. Thus, the whole circumferential force can be born and dispersed and transferred all around. The numbers and the positions of the transverse spherical bearings 4 and the vertical spherical bearings 3 arranged on each bearing beam 5 are the same.

Further, the transverse spherical bearings 4 and the vertical spherical bearings 3 are two-way bearings respectively, so that both ends of each of the transverse spherical bearings 4 and the vertical spherical bearings 3 can be connected and mounted. Moreover, the structure is symmetrical, which not only has good stress performance, but also facilitates mounting and using. Spherical two-way special bearings are used, which allows longitudinal and transverse rotation, and facilitates the adjustment of stress.

Further, leveling pads 6 are respectively arranged at the two ends of each of the transverse spherical bearings 4 and the vertical spherical bearings 3. The leveling pads 6 can adjust the positions of the vertical spherical bearings and the transverse spherical bearings and apply a pre-tightening force to these bearings, which can ensure that the mounted internally embedded small steel box girder is placed horizontally absolutely, reduce the risk that the internally embedded small steel box girder 2 is disengaged from the vertical spherical bearings 3 and the transverse spherical bearings 4, and improve the safety performance.

Further, the bearing beam 5 is formed by welding a plurality of partition plates, which is simple and effective in structure, and easy to fabricate.

Further, a plurality of small beams 8 are also circumferentially arranged on the inner periphery of the externally sleeved large steel box girder 1; and a plurality of longitudinal beams 9 are arranged between each small beam 8 and the corresponding bearing beam 5.

The strength and the stability of the externally sleeved large steel box girder 1 can be enhanced by the arrangement of the small beams 8 and the longitudinal beams 9. Moreover, the longitudinal beams 9 can be connected to a grid-shaped spatial structure of the inner periphery formed by the bearing beams 5 and the small beams 8, which improves the stress performance while providing effective support. The structural strength and the stability of the longitudinal beams are also improved.

Further, the externally sleeved large steel box girder 1 is a discontinuous large steel box girder; and a sealing device 7 is mounted at a discontinuous position of the externally sleeved large steel box girder 1. The large steel box girder arranged in this way facilitates the mounting of the internally embedded steel box girder, and reduces the construction difficulty.

Further, the internally embedded small steel box girder 2 is a segmental symmetric prefabricated structure; and all sections of structures are spliced by high-strength bolts or welding. Prefabrication in a factory is facilitated, and the assembling on site is facilitated.

Embodiment 2

The present embodiment provides a construction method for the mid-span axial force-free connecting device for an earth-anchored cable-stayed bridge in Embodiment 1.

A method for mounting the mid-span axial force-free connecting device for an earth-anchored cable-stayed bridge includes the following steps:

(1) the externally sleeved large steel box girder 1 and the internally embedded small steel box girder 2 are prefabricated and produced in a factory, and are transported to a construction site for later use;

(2) a plurality of leveling pads 6 are respectively mounted on each bearing beam 5 in the externally sleeved large steel box girder 1 according to an upper-lower left-right symmetrical relationship, and then the transverse spherical bearings 4 and the vertical spherical bearings 3 are respectively mounted on the bearing leveling pads 6 according to a transverse-vertical relationship;

(3) after the externally sleeved large steel box girder 1 is subjected to centering and spacing adjustment, the vertical spherical bearings 3 and the transverse spherical bearings 4 are adjusted to preset positions;

(4) the internally embedded small steel box girder 2 are hoisted and fed into the externally sleeved large steel box girder 1, the leveling pads 6 are adjusted to ensure that the internally embedded small steel box girder 2 closely fits the vertical spherical bearings 3 and the transverse spherical bearings 4, and the mounted internally embedded small steel box girder 2 is mounted horizontally; a pre-tightening force is applied to each of the vertical spherical bearings 3 and the transverse spherical bearings 4 in a mounting process of the internally embedded small steel box girder 2;

(5) after the internally embedded small steel box girder 2 is mounted, a longitudinal limiting stop block is arranged at each of the two ends of the internally embedded small steel box girder 2; and finally, a sealing device 7 is mounted at a discontinuous position of the externally sleeved large steel box girder 1.

The mounting method is simple, and effectively improves the construction progress of a steel box girder. The mounted internally embedded small steel box girder 2 has good levelness, and both the stability and stress characteristics are superior to those of an ordinary steel box girder. The thickness dimension of the leveling pad is adjusted correspondingly in combination with a final bridge line and on-site monitoring data in an actual machining process. The applied pre-tightening force value is adjusted correspondingly according to an actual engineering stress condition and the allowable longitudinal displacement, and the longitudinal limit value allows the longitudinal displacement to be adjusted correspondingly in actual engineering.

Although the embodiments of the present disclosure have been shown and described, those of ordinary skill in the art can understand that a variety of changes, modifications, substitutions and variants can be made to these embodiments without departing from the principle and purpose of the present disclosure, and the scope of the present disclosure is defined by the claims and their equivalents.

What is claimed is:

1. A mid-span axial force-free connecting device for an earth-anchored cable-stayed bridge, the device comprising an externally sleeved large steel box girder and an internally embedded small steel box girder arranged inside the externally sleeved large steel box girder a plurality of bearing beams arranged on an inner periphery of the externally sleeved large steel box girder;

a set of transverse spherical bearings;

a set of vertical spherical bearings;

wherein transverse spherical bearings or vertical spherical bearings from the set of transverse spherical bearings or from the set of vertical spherical bearings, respectively are arranged on the plurality of bearing beams; wherein the internally embedded small steel box girder is fixedly supported at a set of sections in the externally sleeved large steel box girder through a plurality of symmetrically arranged transverse spherical bearings and symmetrically arranged vertical spherical bearings from the set of transverse spherical bearings and from the set of vertical spherical bearings, respectively.

2. The device according to claim 1, wherein there are 16 transverse spherical bearings and 8 vertical spherical bearings; the vertical spherical bearings are arranged on an upper side and a lower side; and the transverse spherical bearings are arranged on a left side and a right side.

3. The device according to claim 1, wherein the plurality of bearing beams are circumferentially arranged on the inner periphery of an externally sleeved large steel box girder at a set of intervals; one vertical spherical bearing is arranged on each of an upper side and an lower side of the bearing beam; and two transverse spherical bearings are arranged on each of the left side and the right side of the bearing beam.

4. The device according to claim 1, wherein the transverse spherical bearings and the vertical spherical bearings are two-way bearings respectively.

5. The device according to claim 1, wherein leveling pads are arranged at each of two ends of each of the transverse spherical bearings and the vertical spherical bearings.

6. The device according to claim 1, wherein each bearing beam of the plurality of bearing beams is formed by welding a plurality of partition plates.

7. The device according to claim 1, wherein a plurality of small beams are also circumferentially arranged in the externally sleeved large steel box girder; and a plurality of longitudinal beams are arranged between each small beam and a corresponding bearing beam.

8. The device according to claim 1, wherein the externally sleeved large steel box girder is a discontinuous large steel box girder; and a sealing device is arranged at a discontinuous position of the externally sleeved large steel box girder.

9. The device according to claim 1, wherein the internally embedded small steel box girder is a segmental symmetric prefabricated structure; and wherein all segmented sections of the prefabricated structure are spliced by high-strength bolts or welding.

10. A method for mounting the mid-span axial force-free connecting device for an earth-anchored cable-stayed bridge according to claim 1, the method comprising prefabricating and producing the externally sleeved large steel box girder and the internally embedded small steel box girder in a factory, and transporting to a construction site for later use;

mounting a plurality of leveling pads on each bearing beam in the externally sleeved large steel box girder according to an upper-lower and left-right symmetrical relationship, and then mounting the transverse spherical bearings and the vertical spherical bearings on the bearing leveling pads according to a transverse-vertical relationship;

adjusting the externally sleeved large steel box girder with centering and spacing adjustments, and subsequently adjusting the vertical spherical bearings and the transverse spherical bearings to preset positions;

hoisting and feeding the internally embedded small steel box girder into the externally sleeved large steel box girder, adjusting the leveling pads to ensure that the internally embedded small steel box girder closely fits the vertical spherical bearings and the transverse spherical bearings, and horizontally placing the mounted internally embedded small steel box girder, and applying a pre-tightening force to the transverse spherical bearings and the vertical spherical bearings in a mounting process of the internally embedded small steel box girder;

arranging a longitudinal limiting stop block at each of two ends of the internally embedded small steel box girder; and mounting a sealing device at a discontinuous position of the externally sleeved large steel box girder.

* * * * *